United States Patent [19]

Ottieri

[11] Patent Number: 4,669,202

[45] **Date of Patent: * Jun. 2, 1987**

[54] SKI BOOT

[75] Inventor: Marco T. Ottieri, Manchester, Mass.

[73] Assignee: Ottieri Enterprises, Boston, Mass.

[ * ] Notice: The portion of the term of this patent subsequent to Jan. 21, 2003 has been disclaimed.

[21] Appl. No.: 655,905

[22] Filed: Sep. 28, 1984

[51] Int. Cl.[4] ..... A43B 5/04

[52] U.S. Cl. ..... 36/120; 36/54; 36/117

[58] Field of Search ..... 36/117–121, 36/50, 105, 54

[56] References Cited

U.S. PATENT DOCUMENTS

| | | | |
|---|---|---|---|
| 3,313,046 | 4/1967 | Werner et al. . | |
| 3,535,800 | 10/1970 | Stohr . | |
| 3,543,421 | 12/1970 | Ader . | |
| 3,609,887 | 10/1971 | Hickmann et al. . | |
| 3,686,778 | 8/1972 | Hornung . | |
| 3,713,231 | 1/1973 | Mochizuki | 36/121 |
| 3,775,872 | 12/1973 | Rathmell . | |
| 3,844,055 | 10/1974 | Koyama et al. . | |
| 3,861,067 | 1/1975 | Koyama et al. . | |
| 3,945,134 | 3/1976 | Ramer . | |
| 4,095,356 | 6/1978 | Robran et al. | 36/121 |
| 4,160,332 | 7/1979 | Salomon | 36/119 |
| 4,190,970 | 3/1980 | Annovi . | |
| 4,196,530 | 4/1980 | Delery . | |
| 4,222,184 | 9/1980 | Kastinger . | |
| 4,338,735 | 7/1982 | Spademan . | |
| 4,461,103 | 7/1984 | Annovi | 36/121 |
| 4,470,206 | 9/1984 | Annovi | 36/121 |

FOREIGN PATENT DOCUMENTS

| | | | |
|---|---|---|---|
| 0053340 | 6/1982 | European Pat. Off. | 36/120 |
| 0099504 | 2/1984 | European Pat. Off. | 36/117 |
| 1806109 | 5/1970 | Fed. Rep. of Germany | 36/120 |
| 2649439 | 5/1977 | Fed. Rep. of Germany | 36/121 |
| 3247516 | 6/1984 | Fed. Rep. of Germany | 36/117 |

*Primary Examiner*—James Kee Chi

*Attorney, Agent, or Firm*—Lahive & Cockfield

[57] ABSTRACT

A ski boot has a base element forming sole, toe and instep portions and which mounts a shin cuff element, a calf cuff element, and a heel seat element with three triangularly located hinging connections. The heel seat element engages a wearer's heel to aid in closure of the cuff elements and to facilitate removal of the boot. A cuff closure automatically engages when the cuff elements are moved to closed positions, and is readily releasable for ease in boot removal. An adjustable instep closure automatically tightens, by way of strap elements coupled with the rear cuff element, upon closure of the boot. The closure mechanism relaxes the instep closure tension when the skier leans forward. The shin cuff element and the toe portion of the base element movably and replaceably seat a forward lean control element so that it may readily be removed and replaced, and the mounting can be adjustable for selecting the forward lean resistance.

5 Claims, 15 Drawing Figures

10
12
12a
12b
12c
14
16
18
20
22
24
26
28
28c
34a
36a
44
76
88
100
114
116
116a
118
120
122
126
128
130
132
134
136
138
140

SKI BOOT

BACKGROUND OF THE INVENTION

This invention relates to ski boots. More particularly, it provides a ski boot structure that enhances numerous mechanical support and other user requirements for comfort and performance in skiing.

A boot according to the invention can be unusually light weight, can provide secure firmness and stiffness of coupling between a wearer's foot and a ski, and yet can provide desired flexibility and yield.

Ski boots have undergone many changes in recent years with the use of synthetic materials, and have employed varied structures to provide various degrees of stiffness, flexibility and adjustment, as well as ease in putting on and taking off, and overall comfort and warmth. The following U.S. patents illustrate recent developments in ski boot structures.

| | |
|---|---|
| 3,313,046 Werner et al | 3,861,067 Koyama et al |
| 3,535,800 Stohr | 3,945,134 Ramer |
| 3,543,421 Ader | 4,095,356 Robran et al |
| 3,609,887 Hickman et al | 4,160,332 Salomon |
| 3,686,778 Horning | 4,190,970 Annovi |
| 3,713,231 Mochizuki | 4,196,530 Delery |
| 3,775,872 Rathmell | 4,222,184 Kastinger |
| 3,844,055 Koyama | 4,338,735 Spademan |

There is a continuing desire and need for greater ease in putting on a ski boot and taking it off, in allowing limited yield when the skier leans forward or back and firmness in the event of further leaning, and in providing stiff resistance to lateral movement and twist. There thus is a continuing pressure in the industry for a ski boot suited to large scale commercial manufacture and which provides exacting coupling between a wearer's foot and a ski for firm and well-controlled skiing, and yet with great ease and comfort in use.

It accordingly is an object of this invention to provide a ski boot structure that advances the attainment of the foregoing features.

GENERAL DESCRIPTION

A ski boot according to the invention has a footreceiving base element that provides sole, toe and instep portions. The sole portion has heel, arch, and ball sections. The base element mounts three further boot elements that supportedly engage the wearer. One is a forward shin cuff element for supportingly engaging the shin of the wearer. Another is a rear calf cuff element that supportingly engages the calf of the wearer. The third is a rear heel element that supportingly engages the back of the heel and ankle of the wearer. The three mounted elements are movable between closed positions in which they provide shin, calf, heel and ankle supporting engagements, and open positions in which they allow the wearer to step in and alternatively out of the ski boot with relative ease.

The ski boot further has the feature that hinge connections mountingly join the shin element, the heel element, and the calf element to the base element. The hinge connection of the shin cuff element to the base element is at a first distance above the sole portion and is located along the length of the base element above the forward end of the heel section. The hinge connection which joins the heel element to the base element is at a second shorter distance above the sole portion and is located along the length of the base element above the rear of the heel section of the sole. The connection which mounts the calf element to the base element is spaced above the sole portion by a third distance greater than both the first and the second distances, and is located along the length of the base element between the other two hinge connections. With this arrangement, the three hinge connections define, in a vertical sideview, a triangular configuration disposed above the heel section of the sole of the boot. The triangle is inverted, with two corners located at nearly the same upper level and well-spaced above the third corner.

The ski boot preferably has a linkage coupled between the heel element and the calf element at a fourth distance which is greater than the other three distances above the sole portion. The linkage selectively transfers movement between the calf cuff element and the heel element. A preferred embodiment of the linkage includes a pin element carried on either the heel element or the calf cuff element, and a slot on the other of these two elements which slidably receives and seats the pin element.

It is also a feature of the ski boot to have opposed and inwardly facing caming walls located between the first and second distances above the sole portion and further located along the length of the base element above the heel section. The hingedly mounted heel element according to this feature includes a resiliently compliant heel engaging structure with a U-shaped horizontal cross section. The arms of the U-shape progressively engage the caming walls upon movement of the heel element from the open position to the closed position. This increasing caming engagement increasingly closes the width of the U-shape. This action of the heel element selectively engages the narrowing of a wearer's foot at the Achilles region above the heel when the boot is closed, and releases this engagement when the boot is open.

Another feature of a ski boot according to the invention is that the heel element includes a lower heel-receiving scoop which projects at the base of the heel element toward the toe portion of the boot. The heel-receiving scoop is arranged relative to the second hinge connection for responding to downward heel pressure thereon to produce a force moment about that hinge connection which moves the heel element into the closed position. The heel-receiving scoop on the heel element is further arranged, in a preferred form of the invention, for responding to movement of the heel element from the closed position to the open position for exerting an upward foot-ejecting pressure or force on the heel of a foot seated in the ski boot.

A ski boot according to the invention can also have, as a feature thereof, the aforementioned base element with calf and shin cuff elements hingedly mounted to the base element, and first and second releasable latching closure devices, one carried on each cuff element. The two closure devices latchingly engage upon movement of the two cuff elements into the closed positions thereof, and are releasable for allowing the cuff elements to move to the open position. Further, a release device is coupled to and carried with one of the closure devices. The release device is resiliently biased to a normal latching position, and is movable from that normal latching position for releasing the engagement between the two closure devices. In one preferred form, the closure and release devices can be actuated for allowing the cuff elements to open simply in response to a downward movement such as a wearer can readily affect with a ski pole, hence essentially while standing upright.

A ski boot according to the invention and having a base element as previously characterized and at least a forward shin cuff hingedly mounted to the base element also has the feature that an instep member is adjustably coupled between the base element and the shin cuff for providing selectively resistant stiffness against forward lean by a skier. The boot base element and shin cuff element removably and replaceably mount the instep member for easy removal and replacement. Further, the mounting of the instep member to the boot preferably, according to a further feature, is adjustable, thereby affording further control and adjustment of the response to forward lean which the boot provides.

A ski boot according to the invention also features a base element as previously characterized and hingedly mounting at least a forward shin cuff element and a rear calf cuff element, and which tightens across the instep of the base element automatically when the cuff elements are moved to a closed, foot-engaging position.

The implementation of this feature preferably includes the provision of a skeletal base member having, in addition to substantially rigid sole and toe portions, a peripheral rib configuration extending upward around both sides of the foot instep from the heel portion and thence down the front of the boot along the instep with two side by side instep ribs spaced apart across an instep opening. The automatic closure mechanism selectively closes this instep opening when the boot is closed. The closure mechanism preferably includes tensile members which connect with the instep ribs and pass around and outside the sides of the base section of the boot to an underside sole-recessing chamber. A further tensile element in the chamber couples the straps rearward along the boot, out of chamber, and up the back of the boot to the rear calf cuff. Opening the rear cuff relaxes the tension across the instep closing straps, whereas closure of the rear cuff section tightens the tensile elements in a manner that draws the instep rib members further into the instep opening, thereby tightening the base element of the boot onto the wearer's foot and drawing the foot snugly into the heel of the boot, as desired.

A further feature of the boot structure is that, when closed, it responds to the rotation produced by forward lean of the wearer to relax the closure tension at the instep opening. This allows the instep opening to widen, and thereby accommodate, with added comfort to the wearer, the outward flex of the foot as the forward lean places more weight on the ball of the foot.

The invention accordingly comprises features of construction, combinations of elements, and arrangements of parts exemplified in the constructions hereinafter set forth, and the scope of the invention is indicated in the claims.

BRIEF DESCRIPTION OF DRAWINGS

For a fuller understanding of the nature and object of the invention, reference should be made to the following detailed description and the accompanying drawings, in which.

DESCRIPTION OF ILLUSTRATED EMBODIMENTS

Figure 1:
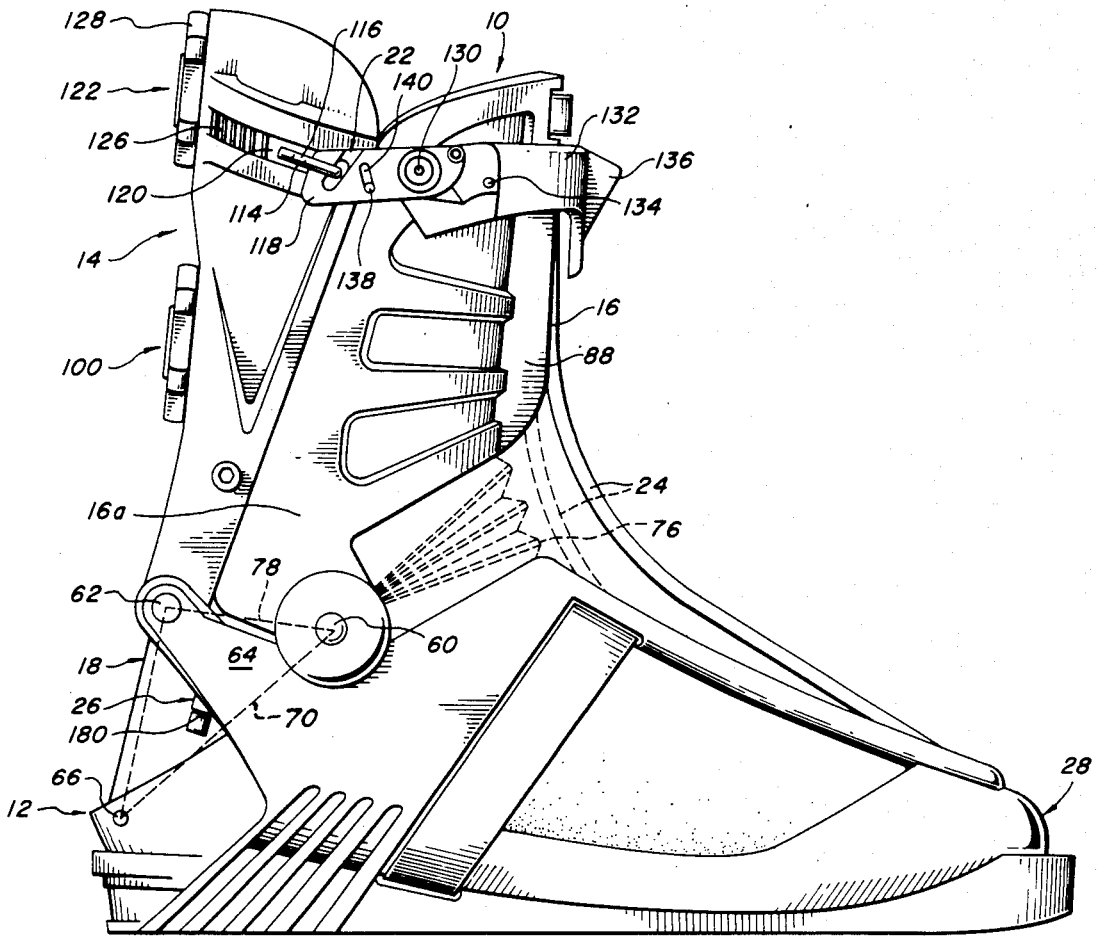
FIG. 1 is a side elevation view of a boot according to the invention in the closed position.
Figures 2, 2A, 2B:
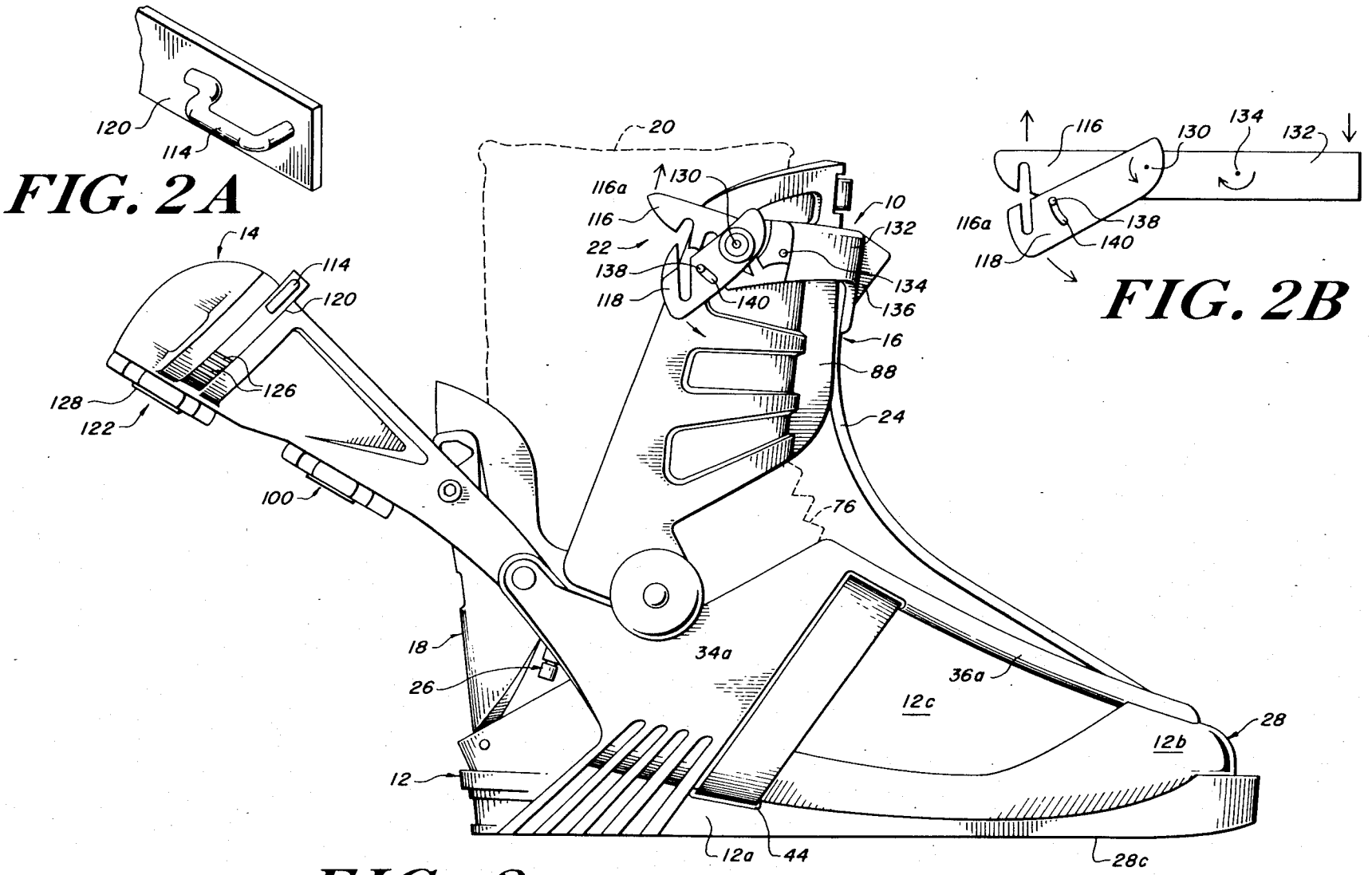
FIG. 2 is a view similar to FIG. 1 of the boot in the open position.
FIGS. 2A and 2B are side elevation views detailing the latching mechanism shown in FIG. 2.

A ski boot 10 according to the invention has, as FIGS. 1 and 2 show, three principal sections: a shoe base section 12 that provides sole, toe and instep portions 12*a*, 12*b*, and 12*c*, respectively, a calf cuff section 14, and a shin cuff section 16. The illustrated boot 10 also has a heel section 18 that, together with the calf cuff section 16, supportingly engages the back of the foot and lower leg, i.e., the ankle and the calf of the wearer. The boot 10 preferably is used with a separate, removably replaceable inner liner 20 that is padded for comfort and is at least snowproof if not waterproof. The liner 20, shown in phantom, can be provided with materials and structures conventional and known for ski boots and is not described further.

Other major elements of the boot 10 are a closure mechanism indicated generally at 22 which holds the boot in the closed position of FIG. 1 and is releasable to allow the calf cuff 16 to swing backwards to the open position shown in FIG. 2. The boot 10 provides adjustable resistance to forward lean by the wearer with a spring element 24. An adjustable stop 26 carried on the shoe section 10 engages the shin cuff section 16 to limit backward or rear lean of the wearer.

With further reference to FIGS. 1 and 2, the illustrated base section 12 has a shoe element 28 that forms the sole, toe and instep portions, and has an instep closure mechanism that is tightened when the boot is closed. A tensile element connects the instep closure with the rear cuff section 14 to provide this automatic tightening. More particularly, the shoe element 28, preferably of one-piece cast construction of a synthetic plastic resin material as conventional in ski boots, has a slipper-like inner configuration for receivably seating the wearer's foot resting on the sole portion 12*a* and seated within the toe portion 12*b* and the instep portion 12*c*. The base section thus forms, along the sole portion, a heel region 28*a* an arch region 28*b*, and a ball region 28*c*. The shoe element 28 has high strength and stiffness along the sole portion 12*a* and in the toe portion 12*b*.

Figure 3:
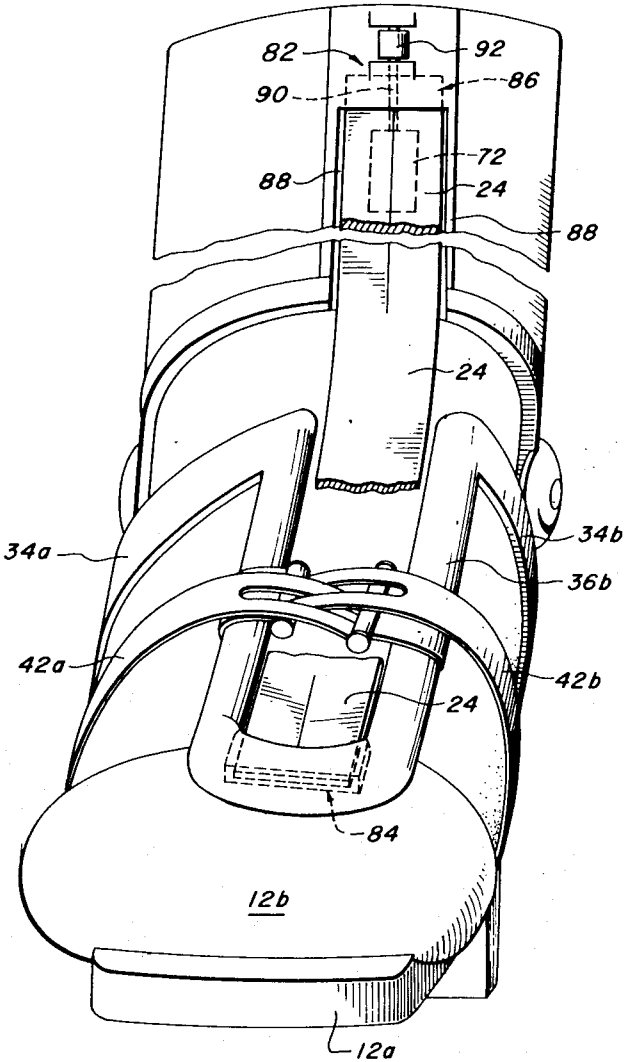
FIG. 3 is a front elevation view of the boot of FIG. 1.

The shoe element 28 also has a pair of bracing ribs 34*a* and 34*b*, shown in FIGS. 1 and 3, that extend upward and forward along the periphery of the shoe element from each side of the heel region 28*a* to opposite sides of the boot instep. Instep ribs 36*a* and 36*b* extend from the upper front instep end of each bracing rib 34*a* and 34*b* respectively, side by side down the front of the boot instep, to the toe portion 12*b*. The instep ribs are spaced apart across the shoe instep by an instep gap 38 and form, with the part of the toe portion that interconnects them, a U configuration when viewed from the front as in FIG. 3. The bracing ribs and instep ribs and interconnecting part of the toe portion preferably are formed, as illustrated, by a continuous bead-like thickening of the material from which the shoe element is molded, i.e., are molded as an integral part of the shoe element 28. This interconnected rib structure hence extends as a continuous unbroken band from the heel region on one side of the shoe element upward and forward along one bracing rib 34*a* to the adjoining instep rib 36*a*, and along the front of the boot to the toe portion. The band continues from the toe portion back and upward along the adjoining instep rib 36*b*, and further backward and down again to the other side of the heel region of the shoe element along the other bracing rib 34*b*. This interconnected rib structure resists tensile elongation and, further, the instep ribs 36*a* and 36*b* resist bending, particularly in the lateral direction, i.e., across the instep gap.

The illustrated shoe element 28 also has, as shown in FIGS. 2 and 3, a tensioning mechanism for closing the boot instep when the boot is closed, FIG. 1. The tensioning mechanism includes a pair of flexible tensioning straps 42*a* and 42*b*, each of which connects at one end to an instep rib 36*b* and 36*a*, respectively, and extends from that connection across the instep gap 38. The straps 42*a* and 42*b* thus cross one another in the span across the instep gap 38. Finger portions preferably are provided on the end of each tensioning strap and which interleave the finger elements of the other strap and join to the instep ribs, as FIG. 3 illustrates, to facilitate providing the crossing of the straps at the instep.

Figure 4:
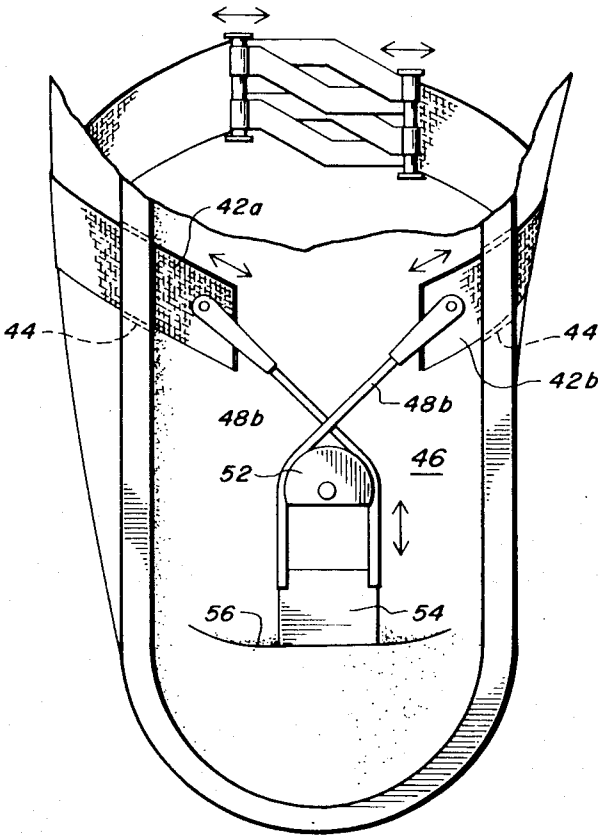
FIG. 4 is a fragmentary view, partly broken away, of the underside of the boot of FIG. 1.
Figures 5, 5A, 5B:
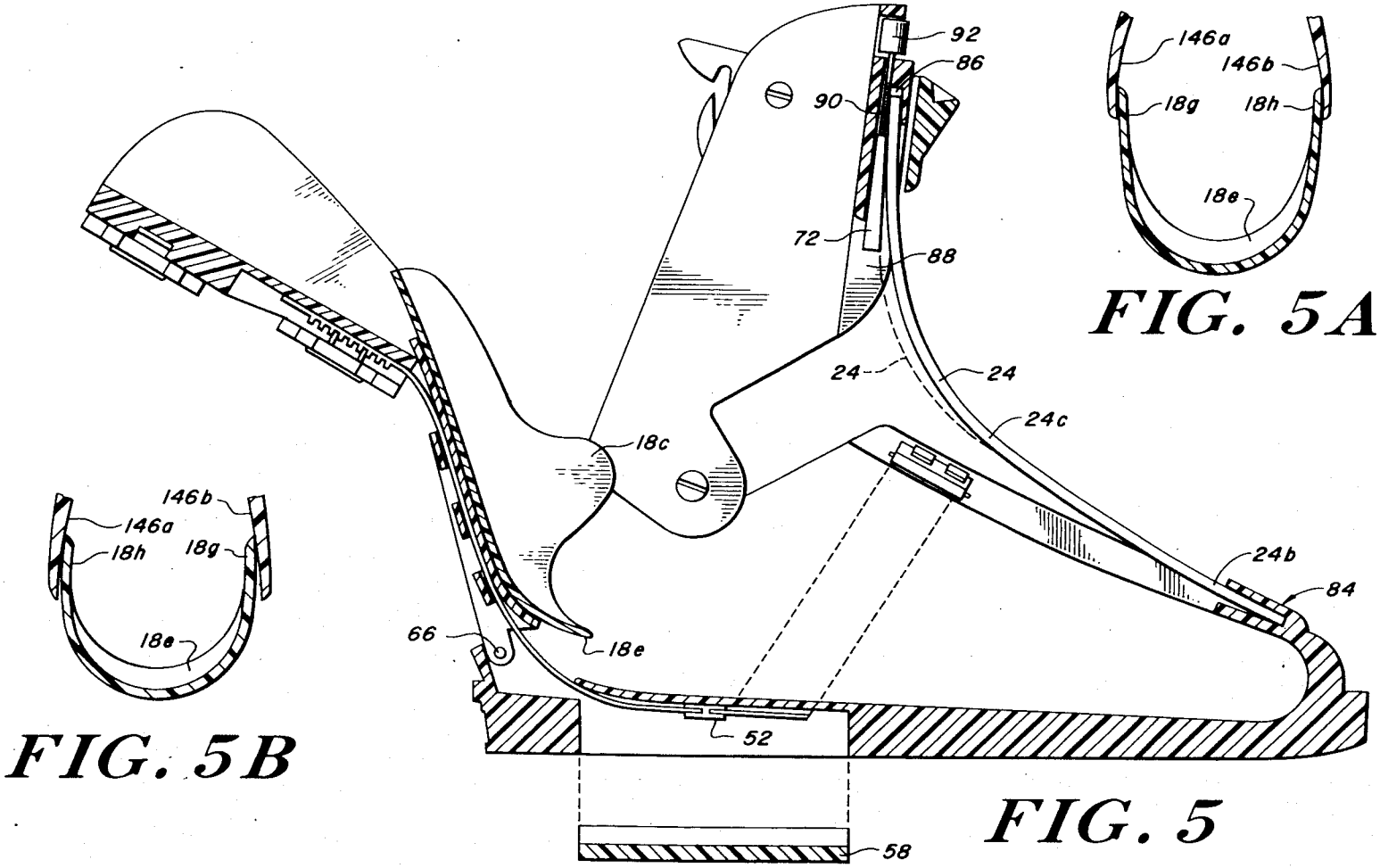
FIG. 5 is a side elevation view similar to FIG. 2 partly broken and partly exploded.
FIGS. 5A and 5B are fragmentary schematic details of a portion of the boot in open and closed positions respectively.

FIGS. 2, 4 and 5 show that each flexible tensioning strap 42*a* and 42*b* further extends outside the boot around the sides of the shoe instep portion 12*c* to pass into the boot through a slot 44 adjacent the sole portion 12*a* into a hollow chamber 46 within the shoe sole portion 12*a* above the heel region 28*a*.

A flexible tensile cable 48*a* and 48*b* is fastened, as with a hinged pin connection as FIG. 4 illustrates, to the end of each tensioning strap 42*a* and 42*b*, respectively, within the chamber 46. The tensile cables 48*a* and 48*b* extend around an idler block 52 fixed to the shoe element 28 in the chamber 46, and then each joins to a single tensile strap 54. The shoe element 28 has, as FIG. 5 shows, a sole plate 58 removably and replaceably fitted in the sole portion 12*a* for providing access to the solechamber 46. The plate preferably is secured in place with interfering detent projections or removable and replaceable fasteners, such as a pin or a screw. When the plate is removed, the chamber 46 is accessible for assembly and adjustment of the tensioning mechanism and, when seated in the sole, provides a tight mechanical seal to close the chamber 46 from snow, dirt and the like.

Figure 6:
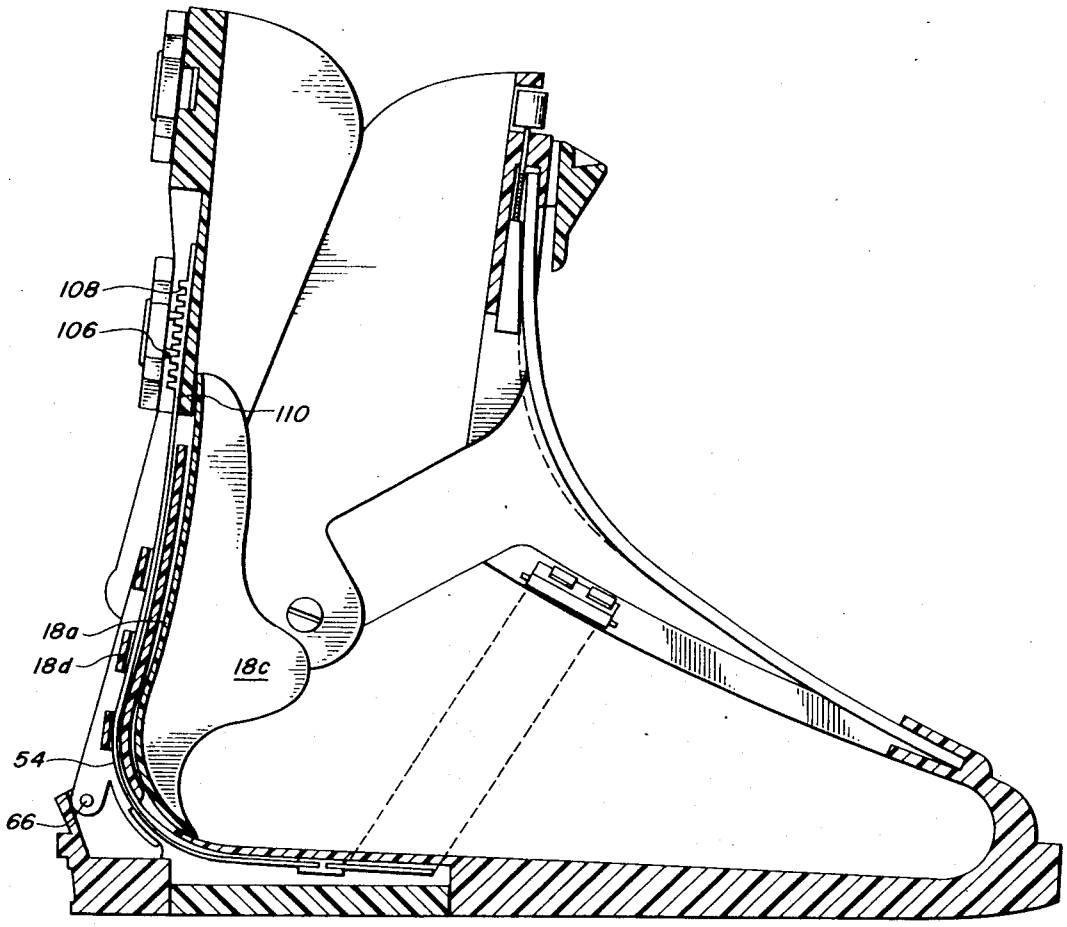
FIG. 6 is a side elevation view similar to FIG. 1 and partially broken away.
Figure 7:
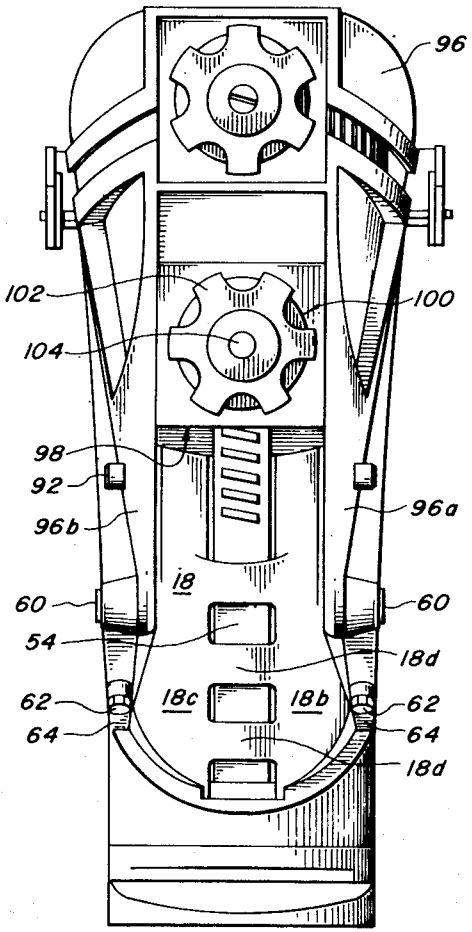
FIG. 7 is a rear elevation view of the boot of FIG. 1 in the closed position.

With further reference to FIGS. 4, 6 and 7, the tensile strap 54 extends rearward along the boot within the chamber 46 and, at the heel end of the shoe element 28, passes out of the chamber through a further slot 56. The strap extends from the slot upward along the exterior of the boot behind the heel section 18 to the calf cuff section 14.

As described further hereinafter, the strap 54 is slack, i.e., essentially free of tension, when the rear calf cuff section 14 is in the open position, FIGS. 2 and 5. Accordingly, the tensile cables 48*a* and 48*b* (FIG. 4) are slack, as are the tensioning straps 42*a* and 42*b*. As a result, the tensioning straps 42 do not resist movement of the instep ribs 36*a* and 36*b* to widen the instep gap 38. Hence, when the rear cuff is open, the boot instep is essentially in an open position, to facilitate putting on and taking off the ski boot.

Moving the rear calf cuff section 14 to the closed position, however, tensions the strap 54, pulling it up along the back of the boot and hence rearward in the bottom chamber 46, see FIGS. 4 and 6. The tensile cables 48 couple this pull to the two tensioning straps 42*a* and 42*b*, which in turn pull the instep ribs 36*a* and 36*b* laterally into the instep gap 38, thereby narrowing the gap. This action closes the width of the instep of the boot and thereby pulls the foot of the wearer downward and toward the heel of the boot, as desired for skiing action. The coupling of the tensile strap 54 to the boot rear calf cuff section 14, and the adjustment of the strap 54 tension when the boot is closed, are described hereinafter.

With reference again to FIGS. 1 and 2, the boot shoe section 12*a* mounts the front shin cuff section 16 to the shoe element 28 by means of aligned pins 60—60, on either side of the boot, and hence with a hinge connection that allows the shin cuff section 16 to rotate relative to the shoe element 28 about the axis of the pins 60. The pins 60 form this hinge connection at a selected first distance above the bottom of the boot sole, and at a first distance along the length of the boot sole adjacent the front of the heel region 28*a*. A second hinge connection, formed by a pair of aligned pins 62, 62 on either side of the boot, mounts the rear calf cuff section 14 to the shoe element 28. The illustrated shoe element 28 has a pair of mounting arms 64, 64 which project rearwardly and upwardly from the bracing ribs 34*a* and 34*b* on either side of the shoe element, as appears in FIGS. 1 and 8. The hinge pins 62, 62 are carried on the far ends of these mounting arms 64 to locate the hinge connection to the calf section 14 at a third distance above the base of the boot sole slightly greater than the first distance, and at a location along the length of the boot further to the rear of the boot than the hinge connection of the front cuff section 16. A third hinge connection located at a significantly lower second distance above the bottom of the boot sole and at a extreme rear location along the length of the boot hingedly mounts the heel section 18 to the shoe element 28. A single pin 66 secured to the shoe element and engaging the heel section 18 forms this hinge connection.

The three hinge connections formed by the pins 60, 62 and 66 have parallel, horizontal and laterally-extending hinge axes and, when viewed from the side of the boot as in FIGS. 1 and 2, form an inverted triangular configuration 70. The corner of this triangular configuration formed by the hinge connection of the heel section 18 is lowermost and rearmost, and the corner at the pin 62 mounting the rear calf section 14 is uppermost. The third triangular corner, mounting the front shin section, is frontmost and slightly below the level of the hinge connection formed by the pins 62.

This multiple hinged connection of the cuff sections 14 and 16 and of the heel section 18 to the boot shoe section 12 facilitates opening and closing the boot for putting it on and off, and for securely closing it onto the wearer's foot. It also provides desired actions of the cuff sections 14 and 16 when the wearer leans forward, and back, during skiing, and it facilitates desired tensioning of the instep tensioning straps 42*a* and 42*b*, which are operatively coupled with the rear calf cuff section 14.

With reference to FIGS. 1, 2 and 5, the front shin section 16 of the illustrated boot 10 preferably is molded in one piece with a shin-supporting interior configuration and having a rib-strengthened skeletal structure to provide the desired strength with minimal weight. Depending leg portions 72*a* and 72*b* join the section 16 to the shoe element 28 at the pins 60—60 at the sides of the boot. Forward of the depending leg portions, the front cuff section 16 is spaced from the shoe element 28 to provide an open instep-flexing region 74. This open region can, where desired, be closed with a pleated or otherwise flexible instep bladder 76, shown in phantom.

The cuff leg portions 72*a* and 72*b* extend rearward from the hinge connection at pins 60 and above the mounting arms 64, 64 of the shoe element 28 to form, at the bottom of each leg portion, a lean-controlling abutment surface 78 on either side of the boot, FIG. 1. A stop post 80 is threadably mounted to each mounting arm 64 to project upward above the mounting arm for an adjustable distance and into interfering abutting engagement with one abutment surface 78. This combination of the abutment surfaces 78, 78 on the front cuff section 16 and the stop posts 80, 80 on the shoe element 28, spaced rearward from the pins 60—60, forms the adjustable stop mechanism 26 that limits the back or rear lean of the cuff section 16 relative to the shoe element. Each stop post 80 preferably has an externally-accessible knurled head to allow manual adjustment of the maximum allowable rear lean angle. The instep flexing opening allows relatively unrestricted forward and backward lean of the front cuff section 16 relative to the shoe element 28.

With reference to FIGS. 5, 3 and 6, the spring 24 provides selected control of this forward lean. As illustrated, the spring preferably is a leaf spring with creased and hence relatively stiff end portions 24*a* and 24*b* and with a flat and hence resiliently-flexible middle portion 24*c*. The boot 10 mounts the spring 24 facing forward, to the right in FIG. 6, and spanning between the toe portion 12*a* and the upper portion of the shin cuff section 16. The illustrated boot provides this mounting with a pocket 84 recessing the upper wall of the toe portion 12*b* and which opens into the instep gap 38. The pocket 84 is configured as a thin, flat reentrant cavity to receive and seat the lower end 24*b* of the spring, as FIGS. 3 and 6 show. The other, upper spring end portion 24*a* is similarly seated in a pocket 86 carried on the shin cuff section 16. The cuff section 16 preferably, as illustrated, has a frontal channel in which the spring upper portion freely is received. The channel is between a pair of cuff-strengthening and spring-shielding ribs 88, 88.

A tension-adjusting wedge block 72 is slideably seated in the channel underneath the spring 24. A lead screw 90, having an externally-accessible knurled adjustment knob 92, is journal-mounted to the front cuff section 16 and threadably engages the wedge block 72. The upper portion of the spring 24 bottoms against the wedge block when the spring deflects, which occurs when the wearer leans forward. Rotation of the lead screw 90 moves the wedge block along the channel and hence along the length of the spring 24, and thereby adjusts the amount of spring deflection which can occur before the spring bottoms against the block. Hence, when the lead screw draws the wedge block up, FIG. 5, the spring bottoms after relatively little deflection, whereas the spring can deflect by a significantly larger amount before being stopped by the block, when the lead screw is rotated to shift the block down on the front cuff section.

One alternative, or added, way to adjust the control of forward lean by the spring 24, and not shown, is to provide the pocket 86 in a seperate block that is slideably seated in the channel 82 on the front cuff section. A lead screw, like lead screw 90, or other mechanism, can adjustably position the pocket-forming block up or down along the front cuff section 16, and thereby selectively tension the spring 24.

The spring 24 can be removed and replaced by deflecting the spring fully into the boot instep-flexing opening, (see the deflected spring 24' shown in phantom in FIG. 1) and removing each end from the seating pocket 84, 86. This removal and replacement of the spring 24 is facilitated by moving the wedge block 72 to its lowermost position, where the spring 24 can undergo maximal deflection.

With reference to FIGS. 2, 6 and 7, the rear calf cuff section 14 of the illustrated boot 10 includes a calf cuff element 96 which preferably has a low weight, ribbed, skeletal, molded structure like the front cuff section 16. The rear cuff element 96 has, on either side, depending leg portions 96*a*, 96*b* that engage the pins 62, 62 for hingedly mounting the cuff section 14 to the shoe element 28. The illustrated cuff element 96 has an opening 98 at the back of the boot, between the leg portions 96*a*, 96*b*, opposite the frontal instep-flexing opening 74 between the leg portions 72*a* and 72*b* of the front cuff section 16. Above this opening 98, the cuff element 96 has a rounded configuration, in a horizontal plane, for enveloping and thereby supportingly engaging the sides and back of the wearer's leg at the lower calf.

FIGS. 6 and 7 show that above the opening 98 and centered at the back of the boot 10, the cuff element 96 mounts an adjustable anchorage 100 of the tensile strap 54. The anchorage is adjustable to selectively increase and decrease the tension of the strap 54 when the boot is closed, and hence to adjust the pull which the straps 42*a* and 42*b* (FIG. 3) exert across the instep gap 38 when the boot is closed.

Figure 8:
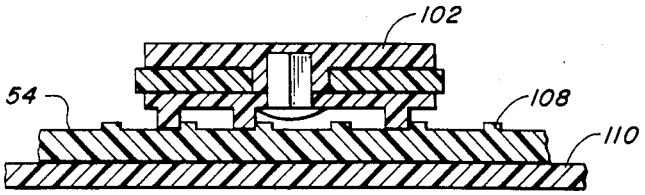
FIG. 8 is a fragmentary sectional view of a portion of the boot in FIG. 1 taken along section line 8—8 of FIG. 7.
Figure 9:
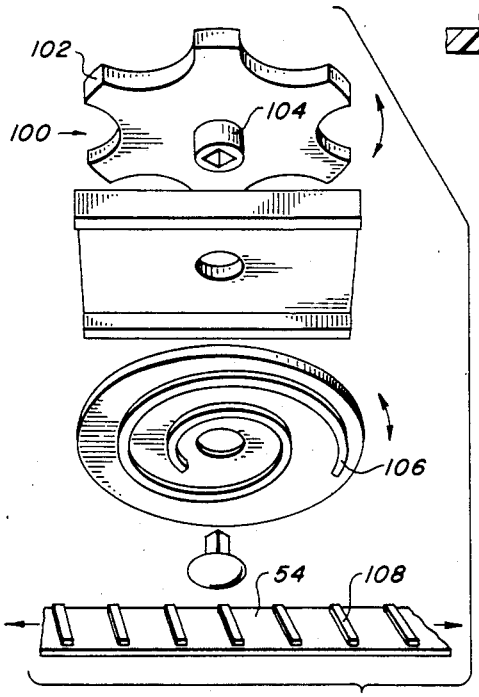
FIG. 9 is an exploded perspective view of an adjustable anchorage for the boot of FIG. 1.

The illustrated anchorage 100, shown in FIGS. 8 and 9, employs a knob or like rotatable element 102 mounted on a shaft 104 and that carries a spiral thread 106 projecting from an inner disk-like surface of the rotatable element 102. The thread 106 engages angled ramping teeth 108 on the strap 54. More particularly, the strap 54 end that fastens to the anchorage 100 is provided with a series of parallel teeth 108, each of which extends across the strap at a selected ramping angle. A bridge-like mounting block 94, secured to the rear cuff element 96, mounts the knob element 102 with the spiral thread 106 engaged with the teeth 108 on the strap 54. More particularly, the knob element has an accessable, external portion at an outer end of the shaft 104. On the underside of the mounting block 94, the shaft carries a spirally-threaded inner disk.

The mounting block 94 thus mounts the rotatable element 102 so that the path of the strap 54 is aligned along a diameter of the element, i.e., the center of the path of the strap passes through the axis of rotation of the element 102. Further, the rotatable element is mounted with the flat surface which carries the spiral thread being parallel with and oppositly by facing the toothed face of the strap 54. The spiral thread 106 on the element 102 accordingly is disposed to engage one or more teeth 108 on the strap, as shown in FIG. 6. One rotation of the rotatable element 102 slides the spiral thread 106 along the teeth 108 in a manner which draws the teeth and accordingly the strap 54 along the path of the strap, thereby tightening the strap. Conversely, opposite rotation of the knob element 102 lengthens and thereby loosens the strap. The anchorage 100 further includes a slide base 110, preferably formed by the mounting block 94, opposite and facing the spiral thread 106. The toothed strap 54 slidably fits between the slide face and the spiral thread, and is held in engagement with the spiral thread by the close spacing of the slide face from the spirally-threaded inner disk.

The anchorage 100 thus formed with the spiral thread 106 and ramping teeth 108 securely fastens the strap 54 to the calf cuff section 14, and yet allows ready adjustment of the strap length and hence of the tension when the boot is closed. Further, the anchorage 100 holds the strap 54 at any given adjusted position, without slippage or other loss of strap position, even when the strap is slack and pushes on the rotatable spiral thread or is taut and pulls on the thread. That is, the anchorage 100 is self-locking against accidental loss of adjustment.

A further feature of the illustrated ski boot is that the anchorage 100 secures the strap 54 to the rear cuff section 14 in a manner that provides an over-center action which relaxes the strap tension during forward lean by the wearer. This diminution of the strap tension allows the instep gap 38, FIG. 3, to widen sufficiently to accomodate the natural widening of the wearer's foot, as the wearer's forward lean places more weight on the ball of the foot. More particularly, FIGS. 1 and 6 show that the connection of the strap 54 to the rear cuff section 14, at the anchorage 100, is located forward of the pin 62 that mounts the section, when the boot is closed. The rear cuff section 14 increasingly lightens the strap 54, upon movement from the open position to the closed position, until the connection of the strap to the section is directly over the mounting pins 62, 62. The further forward movement of the rear cuff section 14 to the closed position, FIG. 1, carries this connection further forward, beyond the orientation where the strap is upright. The rear cuff section 14 thereby moves the connection to the strap 54 slightly but measurably down along the strap. The rear cuff section 14 thus imparts a controlled release of the strap 54, and correspondingly of the instep closure force, as the wearer leans forward in the closed boot. The resultant relaxation of the instep closure accomodates, with significant comfort, the natural widening of the wearer's foot under this leaning condition.

The illustrated boot closure mechanism 22, shown unlatched in FIG. 2 and latched in FIG. 1, employs, on each side of the boot, a catch 114 carried on the rear cuff section 14 and a pair of latch plates 116 and 118 carried on the front cuff section 16. Each catch 114 projects outward on the boot from a mounting band 120; the detail of FIG. 2 shows that each catch preferably forms, with the band 120, a closed loop. At the back of the rear calf cuff section 14 each band 120 carries teeth 124 and is adjustably secured to an anchorage 122. The anchorage 122 preferably is similar in design and operation to the anchorage 100, and carries a spiral thread 126 arranged to move the two diametrically-opposed bands 120 in opposite directions as the thread-carrying rotatable element 128 is turned. The teeth 124 on one band 120 may be inclined or angled opposite from those on the other band, and each band engages only a semi-circular portion of the single spiral thread. The complementary angagement by each set of teeth with only one diametrically-divided half of the spiral thread attains the desired opposite movement of the two bands. Hence rotation of the knob element 128 in one direction lengthens the two straps 120 for projecting each catch 114 further forward from the cuff section 14. Opposite rotation shortens the straps 120 and accordingly draws the catches rearward.

Each latch plate 116 projects rearwardly from the front cuff section 16 and has a downwardly-facing, pin-receiving slot **116*a*. The plate extends rearwardly from a stirrup 132 that encircles the front of the cuff section 16 and is mounted to the section on each side thereof by aligned pins 134. The stirrup 132 has a release lip 136 projecting forward from the front of the cuff section 16. A rotationally acting spring resiliently biases the stirrup 132 counterclockwise to the closed position shown in FIG. 1 where the lip 136 is in an upper position and the plate 116 is in a lower latching position. When the stirrup 132 is in this normal, counterclockwise position to which the spring biases it, and the boot cuff sections are moved to the closed positions of FIG. 1, each catch 114 engages an inclined camming surface 116*b* of a plate 116. This engagement cams the plate 116 upward and thereby rotates it clockwise against the bias of the spring. Further closure motion brings the catch 114 into the mouth of the slot 116*a*. The plate 116 thereupon snaps counterclockwise back to its normal spring-biased position. This motion seats the catch 114 in the slot 116*a*. The closure mechanism 22 then is latched closed, and holds the two cuff sections together, with each catch engaged with a latch plate 116 on each side of the boot. A downward thrust on the stirrup lip 136, whether with a hand or with a ski pole, lifts each latch plate 116 again upward, against the resilient spring bias, and out of engagement with the catches 114**, thereby releasing the closure mechanism.

A latch plate 118 is provided to close each slot **116*a* when the latch mechanism is closed, and thereby to prevent accidental dislodgement or opening of the closure mechanism. The latch plate 118 is mounted to the latch plate 116 for relative rotation with a pin 130 and has an upwardly-facing slot 118*a*, opposite and aligned to communicate with slot 116*a*. The two plates 116 and 118 on each side of the boot 10 thus are like opposed plier jaws rotatable about the pin 130 between an open and catch-releasing position shown in FIG. 2 and a closed position shown in FIG. 1 where a catch 114 is seatingly trapped in overlapping slots 116*a* and 118*a*. Upon closure of the boot, the catch 114 cams the plates 116 and 118** in opposite directions, thereby entering the oppositely facing slots they carry.

A lug 138 projects outward from each side of the front cuff section 116 and slideably seats in a slot 140 in the latch plate 118. The slot 140 is located along the plate 118 between the slot **118*a* and the hinge pin 130. The engagement of the lug 138 with the plate 118 at slot 140, and the hinged connection of the plate 118 to plate 116, form a linkage which rotates the plate 118 counterclockwise and hence opens, FIG. 2, when the stirrup is moved clockwise to release the closure 22**. The spring bias of the latch elements, however, resiliently urges them to the closed position, FIG. 1.

The illustrated closure mechanism 22 is illustrative of numerous latching structures which the boot 10 can employ to secure the cuff sections 14 and 16 closed, and which readily opens to release them. The closure mechanism also can be provided with a snap action to remain open, i.e., with each pair of latch plates 116 and 118 rotated apart, and which then snaps shut upon latching engagement with a catch 114.

The rear heel section 18 of the illustrated boot 10 facilitates putting the boot on and taking it off, and provides a secure seating of the wearer's heel in the boot when the boot is closed. Another feature is that the heel section 18 is linked to the calf cuff section 14 in a manner that enhances freedom of the wearer to lean forward, without constricting the back of the heel and the ankle, particularly in the region of the Achilles tendon, and without constricting the foot instep.

The illustrated heel section, which preferably is cast of a tough synthetic polymer like other sections of the boot 10, has, as shown in FIGS. 2, 6 and 7, a substantially rigid upstanding spine 18*a* with resiliently flexible sidewalls 18*b* and 18*c*. The inner surface of the spine 18*a* is configured to conform with the back of the heel and the Achilles region of the wearer, as FIG. 6 shows. The sidewalls are configured to engage the sides of the foot and ankle as described further below.

The pin 66 that mounts the heel section 18 to the shoe section 12 with a hinge connection engages the heel section adjacent the lower end. The heel section projects upward from this mounting and within the opening 98 between the leg portions 96*a* and 96*b* of the rear cuff element 96. The upper end of the heel section extends upward inside the rear calf cuff section 14, as shown in FIGS. 6 and 7. When the boot is closed, FIG. 6, the cuff element 96 sealingly engages the back of the heel section for sealing out snow and other debris.

FIGS. 6 and 7 show that the rear outside wall of the heel section 18 is channeled for slidingly seating the strap 54, and carries cross-straps 18*d* which pass over the channel to enclose the strap and hold it in place within the channel.

Figure 10:
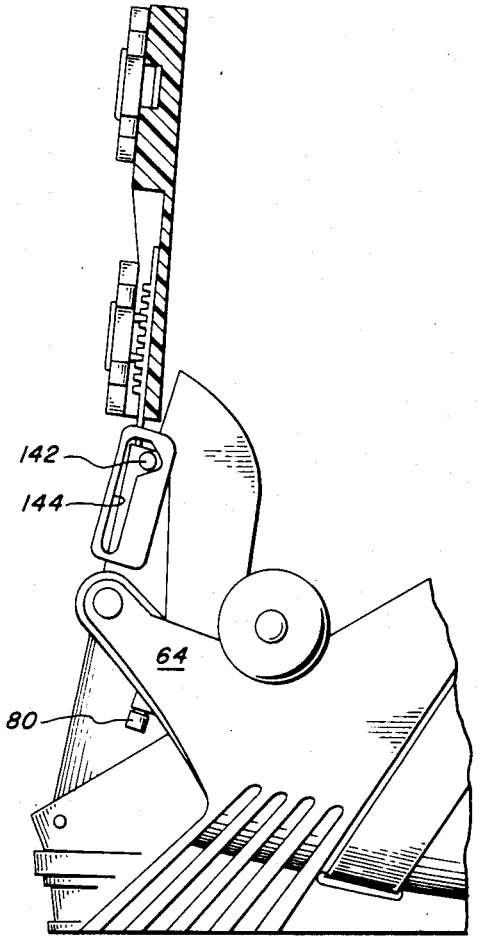
FIGS. 10 and ll are fragmentary side elevation views of the boot of FIG. 1 in closed and open positions, respectively, and showing a linkage coupling between movable elements of the boot.
Figure 11:
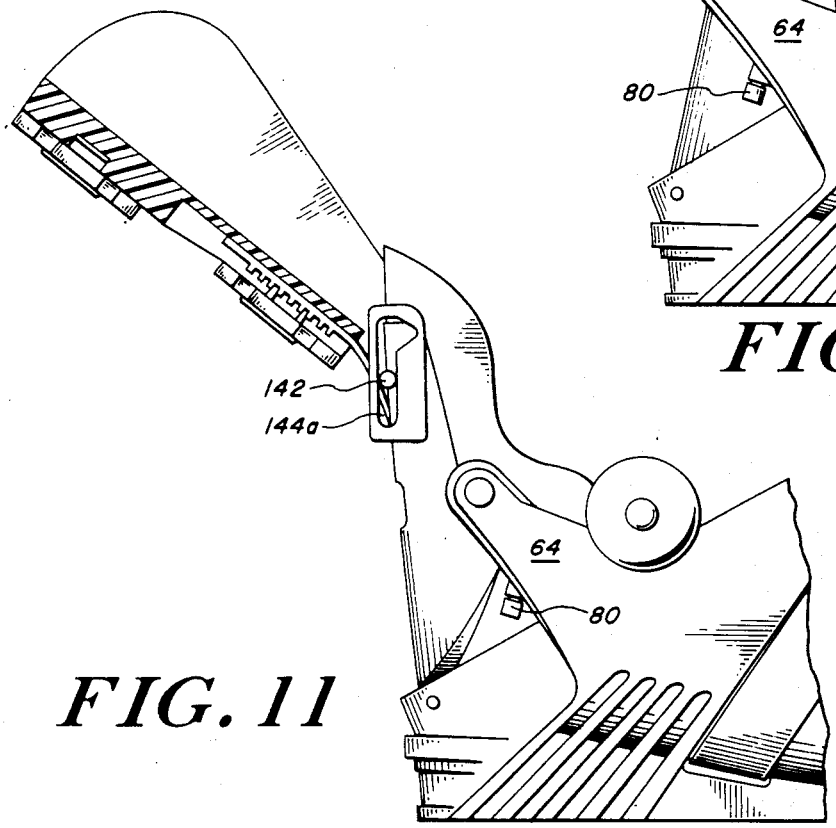

With reference principally to FIGS. 10 and 11, a pin 142 slidably seated in a slot 144 couples the heel section 18, along the upper portion, to the rear cuff element 96. The illustrated boot mounts the pin 142 on the cuff element 96 and provides a pair of slots (shown on one side as 144*a* ) on either side of the spine of the heel section. The height of this pin-slot linkage on the boot is well above the uppermost hinge pin 62 that joins the cuff element 96 to the shoe element 12; as shown it preferably is closely between the top of the opening 98, i.e., where the leg portions 96*a* and 96*b* join with the rest of the cuff element 96. Each slot 144 is elongted longitudinal with the spine 18*a* of the heel section, typically with a straight path as illustrated, and has a frontal enlargement at the upper end.

The linkage which the pin 142 and this configuration of each slot 144 provide between the heel section 18 and the rear cuff section 14, together with the hinging of these two sections to the same shoe section 12 at the two spaced-apart pins 66 and 62, respectively, moves the pin 142 downward along the elongation of the slot when the rear cuff section 14 is rotated counterclockwise, i.e., moved backward, to the open position, FIG. 11. This action draws the heel section 18 counterclockwise to an open position, with the movement of the cuff section 14. Conversely, when the rear cuff section 14 is rotated clockwise (forward) to the closed position of FIG. 10, the pin 142 moves upward in each slot, thereby also rotating the heel section clockwise and forward to the closed position. However, the upper frontal enlargement of each slot 144 allows the pin 142 to move forward in the upper portion of each slot without imparting further movement to the heel section 18, until the cuff section moves so far clockwise that it brings the pin into engagement with the front of the slot enlargement.

The rear cuff section 14 thus moves the heel section 18 to the closed position shown in FIG. 10 and is then free to move further forward, i.e., clockwise. Such further forward movement of the rear cuff section can, for example, occur when the wearer leans forward, as desired in skiing. Thus, a skiier can lean forward in the boot 10 with continued supporting engagement by the rear cuff section 14, without constriction or pinching because the heel section 18 is allowed to remain only in the closed position, without undergoing further closing rotational movement. There also is no pinching or constriction by the cuff section 14 and 16, due to the described placement of the mounting pins 62 and 60, respectively.

The heel section 18 can be configured to augment the above-described release of strap 54, and hence loosening of the instep opening, during forward lean by the wearer. For this optional function, the slot 144 and pin 142 (FIGS. 10 and 11) are arranged initially to move heel section 18 forward with the rear cuff section 14, during forward lean. Further, the back outer side of the heel section is extended, from the embodiment shown in FIG. 6 and relative to the hinge pin 66 about which it rotates, sufficiently to tension the strap 54, as it passes around the heel section, more when the heel section is closed than when the heel section is rotated further forward under a forward lean condition. The heel section 18 thus functions as an idler mechanism, imparting slightly less tension to the strap as the wearer shifts forward from being upright, and hence shifts added weight to the front of the foot.

A further structural element of the illustrated heel section 18 is, as FIGS. 5 and 6 show, an inward curvature on the lower end which forms an inwardly-projecting scoop portion 18*e*. The scoop portion extends in part horizontally along the boot length at a short distance forward of the hinge pin 66, so that a vertical thrust on the scoop portion produce a force moment about the pin 66. The scoop portion 18*e* of the heel section receives, seated thereon, the heel of a wearer. Thus, when a wearer puts the boot on and the heel presses down on the scoop portion 18*e*, the push of the wearer's heel produces a force moment about the hinge connecting pin 66 which tends to rotate the heel section clockwise, FIG. 5, thereby moving it to the closed position, FIG. 6. Conversely, when the wearer is opening the boot and moving the rear cuff section 14 to the open position of FIG. 5, the heel section 18 is also rotated to the open position, as described above. This action presses the scoop portion 18*e* upward, which tends to lift the heel of the wearer out of the boot, thereby facilitating taking the boot off.

FIG. 5 and the details of FIGS. 5*a* and 5*b* show that the sidewalls 18*b* and 18*c* of the illustrated heel section 18 cammingly engage the shoe section 12, upon closure of the boot, in a manner that squeezes the sidewalls together and inward on both sides of the wearer's ankle at the Achilles region. The heel section sidewalls thus enhance the secure seating of the wearer's heel in the closed boot. The heel section sidewalls 18*b* and 18*c*, as seen in the side view of FIG. 5, are roundly tapered from a minimal nil width at the bottom of the section to a larger maximal width at the level of the hinging pins 60 and 62. The large width portion 18*g* and 18*h* of each sidewall is the Achilles seating region. Above this region, the sidewalls roundly taper, illustratively in two steps, to a minimal nil width at the top end of the heel section. The Achilles seating portions of the heel section 18 are free to flare openly apart when the heel section is in the open position, FIG. 5 and 5*a*. As the heel section is moved to the closed position, the seating portions 18*g* and 18*h* of the heel section sidewalls increasingly engage ramping surfaces 146*a* and 146*b* respectively of the shoe section, on the inner surfaces of the mounting arms 64, 64 in the illustrated design. This increasing engagement resiliently deflects the Achilles clamping portions of the sidewalls together, and hence inward toward the sides of the wearer's ankle above the heel and in the region of the Achilles tendon.

The boot 10 preferably affords adjustment of the presure of the seating portions 18*g* and 18*h* against the wearer's ankle. The adjustment is provided by shin-like adhesive pads affixed on the seating portions or on the sidewall ramping surfaces 146*a* and 146*b*, or on both. The ramping surfaces also can be adjustably positioned, by screw-like threaded adjusters, to adjust the amount of camming engagement with the heel section sidewalls. The adjusters are readily provided on each side of the boot for adjustment access from outside the boot, even when it is on a wearer and closed.

The illustrated ski boot thus provides many features of support and of comfort and convenience for a skier. The features are readily and highly advantageously provided together in a skeletally-structured boot as illustrated. Those practiced in the art will appreciate that numerous of the features can be used independently of others and in a variety of ski boot forms and structures. It will thus be seen that a ski boot according to the invention efficiently attains the objects set forth above, among those made apparent from the preceding description. Since changes may be made in the illustrated ski boot without departing from the scope of the invention, all matter contained in the above description or shown in the accompanying drawing is to be interpreted as illustrative and not in a limiting sense.

The following claims are intended to cover all of the generic and specific features of the invention described herein, and all statements of the scope of the invention which, as a matter of language, might be said to fall therebetween.

Having described the invention, what is claimed as new and secured by Letters Patent is:

1. In a ski boot having a base element providing at least sole, toe and instep portions, means forming a leg cuff secured to said base element for supportingly engaging at least the calf and shin of a wearer, and further having a forward lean control element coupled between said base element and said cuff, the improvement comprising A. mounting means on said cuff for mounting said forward lean control element to said cuff, and B. means on said toe portion of said base element for engaging said forward lean control element to said toe portion, C. adjustment means engaged with said lean control element and with said leg cuff means for effecting the lean control operation of said lean control element, and relatively moveable for adjusting said lean control.

2. In a ski boot according to claim 1, the further improvement wherein said forward lean control element comprises selectively resiliently-collapsible elongate spring means removably and replaceably mounted in each of said mounting means and extending therebetween.

3. In a ski boot according to claim 1, the further improvement

A. in which said forward lean control element comprises an elongate flat spring means having substantially flat blade-like end portions, and B. in which each said mounting means includes a slot-like aperture for replaceably and removably seating one said end portion.

4. In a ski boot according to claim 3, the further improvement comprising manual mounting adjustment means for adjusting the position at which one of said mounting means mounts the spring means end portion seated therein.

5. In a ski boot according to claim 1, the further improvement wherein said forward lean control element is replaceably and removably mounted to said ski boot.

* * * * *